United States Patent [19]

Nakayama

[11] Patent Number: 5,007,242

[45] Date of Patent: Apr. 16, 1991

[54] THERMOELECTRIC HUMIDIFIER AND DISPLAY CASE PROVIDED WITH SUCH HUMIDIFIER

[75] Inventor: Hitoshi Nakayama, Kamagaya, Japan

[73] Assignee: Snow Brand Milk Products Co., Ltd., Hokkaido, Japan

[21] Appl. No.: 409,338

[22] Filed: Sep. 19, 1989

[30] Foreign Application Priority Data

Sep. 30, 1988 [JP] Japan ..... 63-128485[U]

[51] Int. Cl.[5] ..... F25B 21/02

[52] U.S. Cl. ..... 62/3.2; 62/92; 62/247

[58] Field of Search ..... 62/3.2, 3.3, 3.4, 247, 62/92

[56] References Cited

U.S. PATENT DOCUMENTS 3,740,959 6/1973 Foss ..... 62/3.4

*Primary Examiner*—Henry A. Bennett
*Assistant Examiner*—John Sollecito
*Attorney, Agent, or Firm*—Griffin Branigan & Butler

[57] ABSTRACT

Here is disclosed a humidifier in which a water reservoir is provided on a heat radiating side of an element having Peltier effect and said element is energized so that a quantity of water filling said reservoir is heat-evaporated by calorific power radiated from said element and water vapor thus obtained is used to protect foods, cake, dairy products etc. against drying. More preferably, a blowing fan is provided on the cooling side of the Peltier element and cooled air stream is exhausted together with the air stream containing heated stream through a common outlet. Said humidifier may be located on the outlet side of cooled air supplied form a cooling coil of a display case to avoid inconvenience that humidified air might be brought into direct contact with the cooling coil and condensated, with loss of humidified steam.

7 Claims, 4 Drawing Sheets

THERMOELECTRIC HUMIDIFIER AND DISPLAY CASE PROVIDED WITH SUCH HUMIDIFIER

BACKGROUND OF THE INVENTION

The present invention relates to a humidifier used for various purposes, for example, to air-condition a room being heated or to protect foods such as vegetable, cake and dairy products against drying, so as to maintain high humidity environment and also the as to maintain high humidity environment and also the invention relates to a display case provided with said humidifier.

The humidifiers of prior art are based on various means or phenomena, for example, an ultrasonic wave oscillator, atomization of water, evaporation of water by heating, or natural evaporation of water by forced convection of air.

A humidifier utilizing the ultrasonic wave oscillator is disclosed in Japanese Disclosure Gazette No. 1988-46364, in which mist generated by the ultrasonic wave oscillator is supplied into an open display case together with cooled air from the upper part of this open display case in order to protect the articles on display against drying.

As an example of prior art related to the present invention, Japanese Disclosure Gazette No. 1986-96380 discloses a system adapted to utilize an element having Peltier effect and thereby to cool or to heat liquid, e.g., water to drink. Most of such systems comprising the Peltier element have primarily utilized the cooling effect of this element and accordingly found their application in room air-conditioning, cool storage, under-floor cool storage or the like.

For particular foods such as cake and dairy products, water particles obtained from the air humidifying means which utilizes natural evaporation or the like is sufficiently effective. However, the well known means conventionally employed for humidification of perishable foods. e.g., the humidifier utilizing the ultrasonic wave oscillate or atomizion water or the like is not preferable to maintain said particular foods such as cake and dairy products at a desired humidity, since water particles generated by such means have a relatively large particle size and are often condensed to waterdrops clinging to foods, the display case and the other objects.

The water evaporation by the heater or the like has been inconvenient also because humidifying steam introduced into the display case or the refrigerator is at a relatively high temperature and adversely affects an environment to be cooled within the display case.

SUMMARY OF THE INVENTION

A principal objects of the present invention is, accordingly, to provide a humidifier adapted to provide the optimal humidifying effect without adversely affecting the cooling of an environment to be cooled within the display case and a display case incorporating such humidifier.

This object is achieved, according to this invention, by using a humidifier comprising an element having Peltier effect and a water reservoir placed on a heat radiating side of said element so that a quantity of water filling said water reservoir is heated by a calorific power radiated from said element to obtain water vapor.

This measure causes a direct heat transfer between the heat radiating side of the Peltier element and the quantity of water filling said water reservoir to effect the heated evaporation. In this manner, said calorific power radiated from said element provides a desired humidification without heating of air.

Additionally, water particles generated by evaporation to achieve humidication are advantageously fine and, therefore, the humidifier of this invention is optimal to humidify particular foods or the like which are apt to be easily damaged by waterdrops.

In this humidifier, there is provided a blowing fan on the cooling side of the Peltier element so that an air stream containing moisture evaporated from the water reservoir is exhausted together with a stream of cooled air supplied by said blowing fan through a common outlet and thereby humidified air at a relatively low temperature is obtained without adversely affecting the environment to be cooled surrounding said humidifier. Accordingly, a total amount of heat is substantially uniform and there occurs no loss of cooling efficiency for the environment to be cooled.

Furthermore, said humidifier may be placed adjacent an outlet of cooled air provided by a cooling coil of the display case to avoid a situation that the air stream humidified by said humidifier might be brought into direct contact with the cooling coil and thereby condense. Thus, there occurs no loss of humidified steam. Finally, the humidifier of this invention can be easily installed in the existing display case, because installation of the humidifier is possible without any substantial modification of the refrigerating system or the structure of the display case.

BRIEF DESCRIPTION OF THE DRAWINGS

The above and other objects of the invention will be seen by reference to the description taken in connection with the accompanying drawings, in which:

FIG. 4 is a view similar to FIG. 3, showing the humidifier of the present invention as being utilized by a display case for foods or the like.

DETAILED DESCRIPTION OF THE INVENTION

The invention will be described by way of example in reference with the accompanying drawing.

Figure 1:
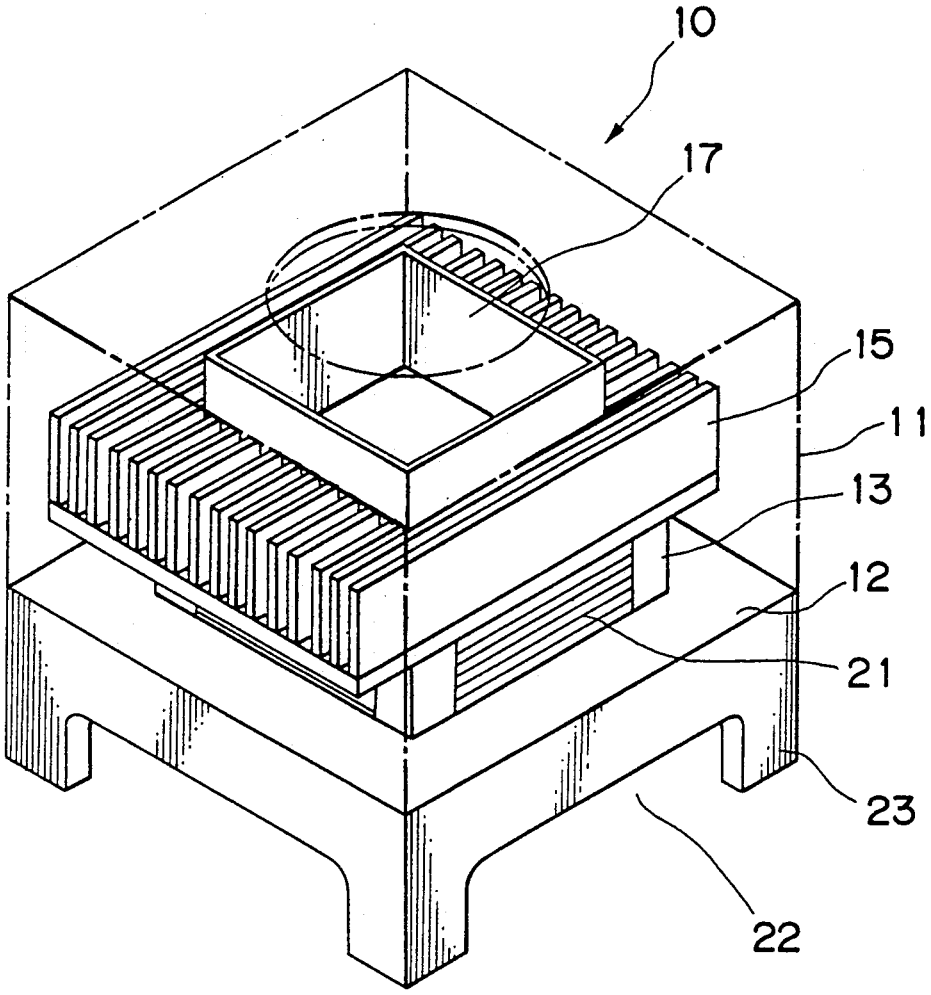
FIG. 1 is a transparent perspective view showing a first embodiment of the humidifier constructed in accordance with the present invention.
Figure 2:
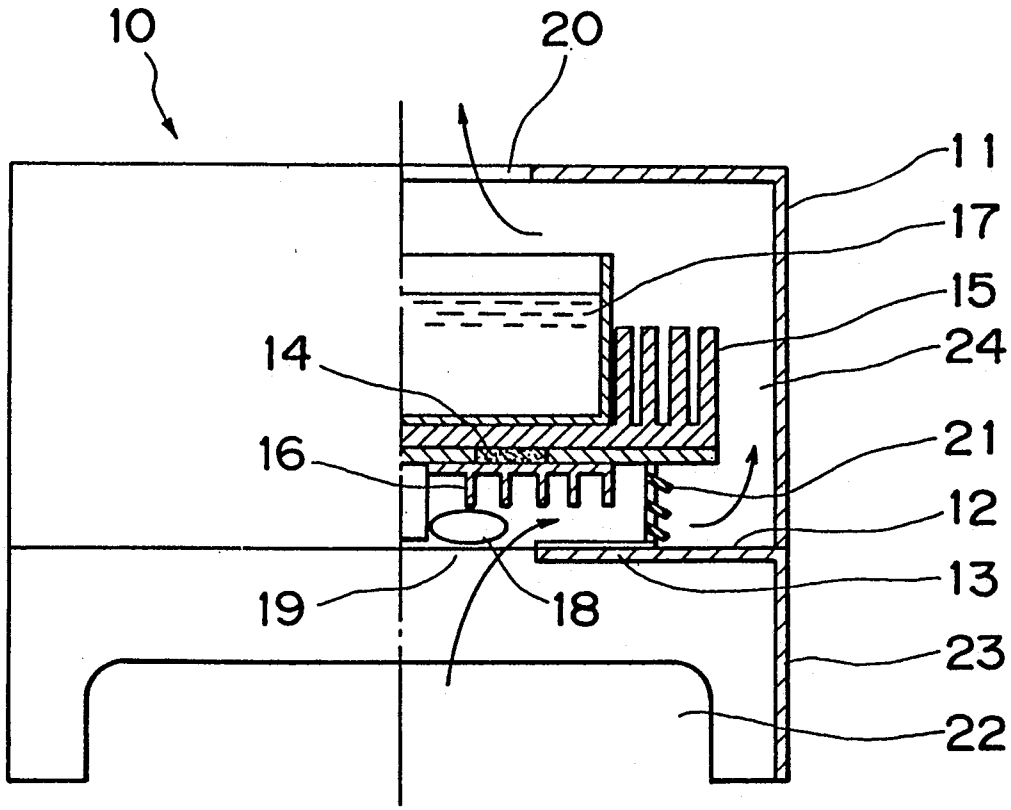
FIG. 2 is a side view showing, as partially broken away and partially in section, the humidifier of FIG. 1.

FIGS. 1 and 2 illustrate the first embodiment of the humidifier constructed according to this invention.

Referring to FIGS. 1 and 2, a humidifier 10 is adapted to utilize a heat radiating effect and a cooling effect of a Peltier element 14 to achieve a desired humidification. There is provided around the humidifier 10 a housing 11 which is, in turn, provided therein with a shelf plate 12 defining a bottom of the housing 11. The shelf plate 12 is supported by a pedestal 23 which defines a passage 22. There is provided on the shelf plate 12 a supporting frame 13 integrally with said shelf plate 12. Above the support frame 13 there are provided heat radiating fins 15 and cooling fins 16 so that the Peltier element 14 is sandwiched between said heat radiating fins 15 disposed thereabove and said cooling fins 16 disposed thereunder. The Peltier element 14 is surrounded by a Bakelite block and, upon energization, heated on the side of said heat radiating fins 15 and cooled on the side of said cooling fins 16. Thus, heat radiation occurs above the Peltier element 14 and cooling occurs below the Peltier element 14.

As said cooling proceeds below the Peltier element 14, outer air introduced by a cooling fan 18 through an inlet 19 formed in the shelf plate 12 into the housing 11 flows, after cooled by the cooling fins 16, through ventilation openings 21 of the support frame 13, the heat radiating fins 15, and a space 24 defined between a water reservoir 17 and the housing 11 and then exits from the housing 11 through an outlet 20 formed in a top of the housing 11.

At the same time, heat radiation by the heat radiating fins 15 heats the water reservoir 17 surrounded by these heat radiating fins 15 and a quantity of water filling this water reservoir 17 begins to be evaporated. As a result, steam flows together with heat radiating air to said outlet 20 formed in the top of the housing 11 and exits from the housing 11 through this outlet 20.

In this manner, steam and heat radiating air generated at the heat radiating side of the Peltier element 14 are exhausted together with cooled air generated at the cooling side of the Peltier element 14 through the common outlet 20 formed in the top of the housing 11. In other words, the humidification does not rely exclusively on heat radiation and, accordingly, an amount of heat generated by the humidifier is reasonably low. Thus, the requirement for simultaneously humidifying and cooling a given environment is met by the humidifier 10 of this invention without adversely affecting the environment to be cooled. In addition, water particles in the air stream exhausted through the outlet 20 exhibit a reasonably small particle size because such air stream has been humidified by evaporation.

Figure 3:
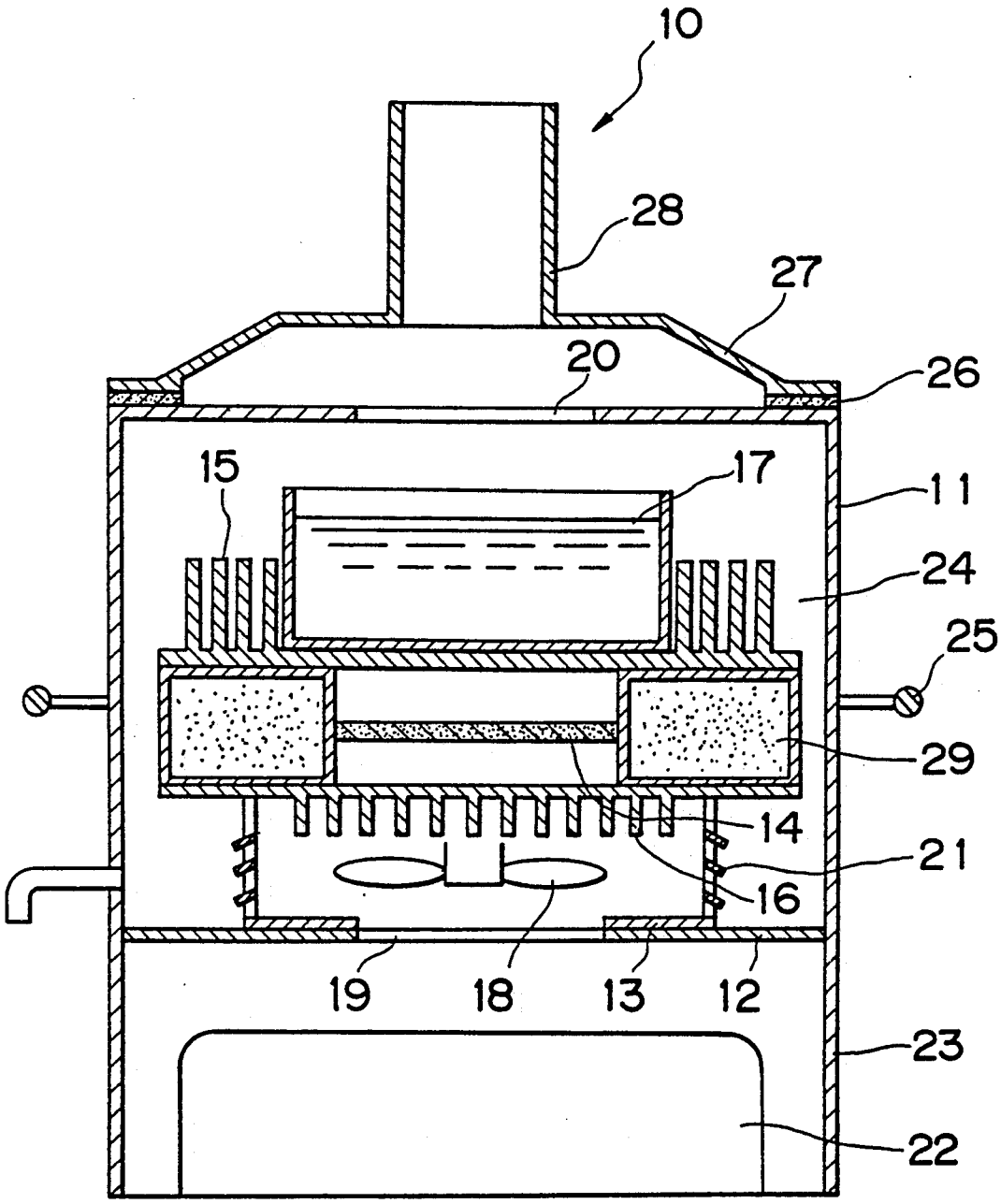
FIG. 3 is an axially sectional view showing a second embodiment of the humidifier constructed in accordance with the present invention.

FIG. 3 illustrates the second embodiment of the humidifier constructed in accordance with the invention. In this embodiment, handles 25 are mounted on opposite side walls of the housing 11 so that the humidifier 10 may be portable. The housing is covered above the outlet 20 by a cap 27 with interposition of a packing 26 and said cap 27 is formed with a humidifying lead pipe 28. Such humidifying lead pipe 28 is preferably provided with means adapted to adjust a throat area ratio of the humidifying lead pipe 28 and means adapted to adjust an exhausting rate of steam, for example, a fan. Provision of said humidifying lead pipe 28 facilitates mixing of cooled air and humidified air.

The heat radiating fins 15 and the cooling fins 16 are made of aluminum plates and the Peltier element 14 is connected to the Bakelite block 29 surrounding the element 14. The Bakelite block 29 is supported by the support frame 13. The peltier element 14 is not in direct contact with both the heat radiating fins 15 and the cooling fins 16 in this embodiment. It should be understood that the Peltier element 14 is preferably brought into direct contact with these fins 15, 16 to improve both the heat radiating efficiency and the cooling efficiency.

Though not shown in FIG. 3, there may be provided adjacent the outlet 20 a guide plate adapted to guide a stream of cooled air towards the surface of hot water in the reservoir 17 to bring the stream of cooled air into contact with the surface of hot water in the reservoir 17 and thereby to generate humidified air more efficiently.

Figure 4:
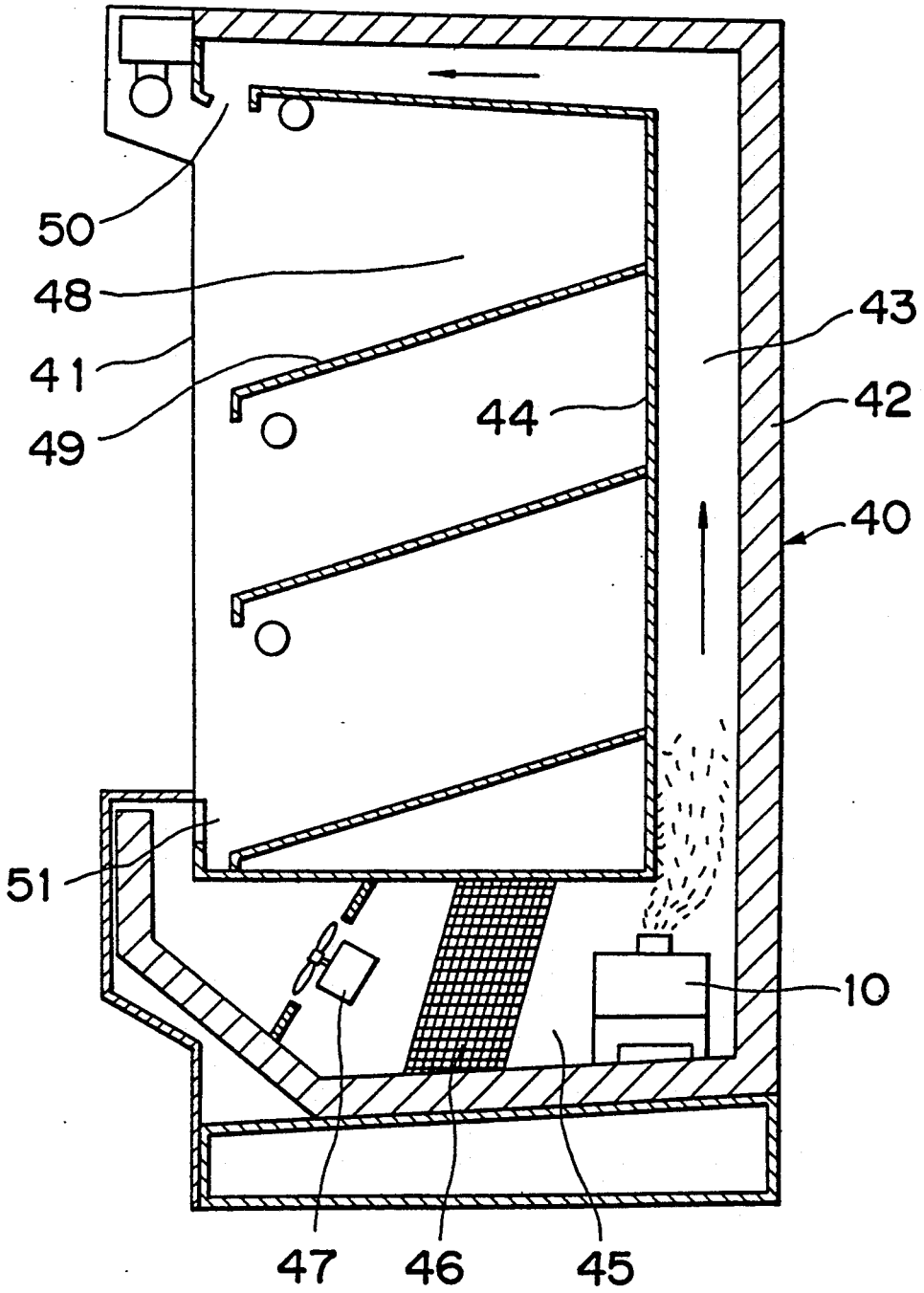

FIG. 4 illustrates a display case incorporated with the humidifier of the invention to store foods or the like. The display case 40 comprises a front opening 41, a rear heat insulting wall 42 and a partition plate 44. A blast passage 43 is defined between said heat insulating wall 42 and said partition plate 44 and a lower space 45 extends adjacent the bottom of said heat insulating wall 42 in fluid communication with said blast passage 43. Within said lower space 45, the humidifier 10 is located downstreams of circulating air, a cooling coil 46 is located upperstreams of it and an air circulating fan 47 is located further upper-streams thereof.

There are provided a plurality of shelves 49 within a storage chamber 48 surrounded by the partition plate 44 and there are provided an air outlet 50 and an air inlet 51 at top and bottom, respectively, between the storage chamber 48 and the front opening 41.

Air supplied by the air circulating fan 47 is cooled by the cooling coil 46, then humidified by the humidifier 10, enters into the storage chamber 48 and forms an air curtain across the front opening 41. Thereafter the air stream passes through the air inlet 51 and exits from the storage chamber 48 and is recirculated by the air circulation fan 47.

With this arrangement, the humidifier 10 humidifies the air stream which has been cooled by the cooling coil 46, namely, humidified air is not brought into direct contact with the cooling coil 46 which would cause undesirable condensation. Specifically, the direct contact of humidified air with the cooling coil 46 would result in condensation of steam into waterdrops clinging to the cooling coil 46, reducing the cooling efficiency thereof and making control of humidification difficult.

Preferably, the humidifier 10 is located at the lower end of the blast passage 43 to facilitate mixing of cooled air with humidified air.

Although the Peltier element is provided horizontally as seen in FIGS. 2 and 3, the Peltier element may be provided to any direction e.g., vertically.

While the invention has been particularly shown and described with reference to preferred embodiment thereof, it will be understood by those skilled in the art that the foregoing and other changes in form and details can be made therein without departing from the spirit and scope of the invention.

What is claimed is:

1. A humidifier for producing cooled and humidified air, comprising:

(1) a Peltier effect element having a heat radiating side and a cooling side;

(2) means for passing air near said cooling side for producing cooled air;

(3) a reservoir for containing a quantity of water disposed apart from but near said heat radiating side such that radiated heat to said reservoir and said water is sufficient to heat said water and to produce water vapor from the quantity of water such as to substantially humidify said cooled air;

(4) passage means for passing said cooled air into and mixing with said water vapor, whereby cooled and substantially humidified air is produced; and (5) an outlet to exhaust said cooled and humidified air from said humidifier.

2. A humidifier as recited in claim, wherein the said heat radiating side of the Peltier element is disposed vertically.

3. A humidifier as recited in claim 1, wherein the Peltier element is provided on the heat radiating side and the cooling side thereof with respective fins.

4. A humidifier as recited in claim 3, wherein the fins on the heat radiating side are above the Peltier element and the fins on the cooling side are below the Peltier element.

5. A humidifier as recited in claim 3, wherein the outlet for said cooled and humidified air is provided as a plurality of separate outlets.

6. A humidifier as recited in claim 5, wherein the outlet is covered and has at least one exhaust pipe connected thereto.

7. A humidifier as recited in claim 1, wherein said humidifier is disposed in the flow of cooled air supplied form a cooling coil to a refrigerated case for displaying refrigerated foods.

* * * * *